US006264794B1

(12) United States Patent
Neumann et al.

(10) Patent No.: US 6,264,794 B1
(45) Date of Patent: Jul. 24, 2001

(54) PROCESS FOR MANUFACTURING GLAZED PAPER

(75) Inventors: Michael Neumann, Heidenheim; Stefan Niederer, Altshausen; Andreas Sauer, Ludwigshafen, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/339,218

(22) Filed: Jun. 24, 1999

(30) Foreign Application Priority Data

Jun. 29, 1998 (DE) ..... 198 28 952

(51) Int. Cl.[7] ..... D21H 23/02; D21H 17/70

(52) U.S. Cl. ..... 162/205; 162/181.1; 162/181.2; 162/181.4; 162/181.5; 162/207

(58) Field of Search ..... 162/9, 158, 181.1–181.2, 162/181.4, 135, 201, 205, 207, 181.5

(56) References Cited

FOREIGN PATENT DOCUMENTS

| | | |
|---|---|---|
| 514595 | 11/1992 | (EP) . |
| 791685 | 8/1997 | (EP) . |
| 0690938 | 9/1997 | (EP) . |

*Primary Examiner*—Jose Fortuna
(74) *Attorney, Agent, or Firm*—Greenblum & Bernstein, P.L.C.

(57) ABSTRACT

The process is used for the production of high-quality glazed paper and includes the three process sections, stock preparation (1), paper formation (2), and glazing (3). According to the invention, the paper fibers used in the performance of the process are subjected to fiber loading, such that substances which reduce the compressibility of the fibers are incorporated in the cavities of the fibers. In combination with the glazing process (3), a paper with particularly high optical quality can then be produced.

20 Claims, 2 Drawing Sheets

PROCESS FOR MANUFACTURING GLAZED PAPER

CROSS-REFERENCE OF RELATED APPLICATIONS

The present application claims priority under 35 U.S.C. § 119 of German Patent Application No. 198 28 952.9, filed on Jun. 29, 1998.

BACKGROUND OF THE INVENTION

1. Field of the Invention

The invention concerns a process of making glazed paper from treated stock.

2. Description of Background and Relevant Information

Processes of this type are conventionally used to produce high-quality, smooth papers. It is known, for example to consider a large number of parameters during paper production in order to the obtain a paper with the required quality in all specifications. In such a process, the production of a smooth surface and, at the same time, good optical properties is of utmost importance. A smooth surface is usually produced when the web of paper is guided at a defined residual moisture level and at specific temperatures between at least two, and usually several, smoothing rolls which are pressed against each other. This process utilizes calenders and has been known and has proven itself for a long time. However, the process encounters limits when, as a result of the pressing force required in the calenders, an optical drawback appears in the form of areas having little opacity. This phenomenon is known as black glazing and, in many cases, it limits optimum glaze production. To be sure, the glaze can be increased by a higher calender pressure; however, at the same time, the optical quality of the paper may be so greatly reduced that, especially with thin papers, significant disadvantages may arise.

SUMMARY OF THE INVENTION

Therefore, the invention provide a process with which a paper can be produced that has both a high glaze and good optical characteristics.

By utilizing of the sequence of process sections described herein, it is possible to make the fibers more resistant to the pressure applied in the calender. It is further possible to increase the fiber volume through these measures, since certain substances can penetrate into the interstitial spaces of the paper fibers and expand them. Furthermore, layers which better distribute the pressure forces of the glazing process can also be formed on the outer surfaces of fibers.

The introduction of substances into the fibers is called fiber loading. To load the fibers, it is possible, for example, to introduce substances such as dissolved salts into the fibrous material suspension. Since paper fibers are known to be hydrophilic and capable of swelling, the dissolved salts can pass through the fiber walls into the interior of the fibers. By using the appropriate chemical treatment, crystal growth, which can expand the fibers, is stimulated within the fibers. Existing fiber cavities (lumens) become coated from the inside by a relatively hard layer or at least filled in some locations. Even if the layer breaks apart during the glazing process, it nevertheless prevents the fiber walls from touching each other. An inexpensive, suitable substance is calcium carbonate, which can be stimulated to crystal growth, for example, by addition of $CO_2$ to an aqueous $Ca(OH)_2$ solution.

EP 0 690 938 B1 discloses a special process in which, with the use of calcium carbonate, it is possible to fill the fiber lumen. This is done to incorporate the maximum amount of fillers into the paper. Fillers are white and opaque. By this process, losses of strength caused by overloading the sheet of paper are claimed to be avoided and, in addition, sheet weight is increased using a relatively inexpensive substance. In this regard, it is reported that the price of carbonate is approximately 20 to 30% of the price of the fibrous material. This process is known as fiber loading.

The process according to the present invention makes use of the special characteristic which paper fibers can acquire by means of the loading of their internal cavities or lumens. It is based on the knowledge that problems which occur at the end of the paper production process, i.e., during glazing, can initially be solved during stock preparation by a special treatment of the fibers.

According to one aspect of the invention there is disclosed a process for the production of glazed paper wherein a stock is prepared by providing a fibrous material suspension for processing in a paper making machine; a paper web is formed, such that the paper web is dried and produced from the fibrous material suspension; and the paper web is glazed using glazing surfaces which are pressed against each other at a pressure. The stock is also subjected to fiber loading in the preparing step using substances which are transported into the paper fibers such that the substances increase the volume of the fibers in their transverse dimension by forming expanding solid layers.

According to another aspect of the invention, the process provides for the paper fibers to have interior cavities defined by fiber walls and the substances are deposited in the interior cavities during fiber loading so as to form a solid layer, thereby providing, one of, a coating on the interior cavities or filling them in some locations. The solid layers are also made to break apart during the glazing step so as to form a separation layer between the fiber walls.

According to another aspect of the invention, the process provides for the substances to penetrate into the paper fibers during the preparation step. The substances being calcium carbonate, such that the calcium carbonate is made to crystallize inside the paper fibers.

According to another aspect of the invention, the process provides for the substances to comprise at least two components which are added to the fibrous material suspension at different times.

According to another aspect of the invention, the process provides for the fibrous material suspension to be produced from recycled paper which is freed of ink by a de-inking process.

The process provides for the glazing to be performed at a pressure of at least 30 $N/mm^2$, and preferably at a pressure of at least 60 $N/mm^2$. The process also provides for the glazing to be performed by a supercalender.

According to one aspect of the invention there is disclosed a process for the production of glazed paper wherein a stock is prepared by providing a fibrous material suspension for processing in a paper making machine; a paper web is formed, such that the paper web is dried and produced from the fibrous material suspension; and the paper web is glazed using glazing surfaces which are pressed against each other at a pressure. The stock is also subjected to fiber loading in the preparing step using substances which are transported into the interior of the paper fibers so as to increase their resistance against compression.

According to another aspect of the invention, the process provides for the paper fibers to have interior cavities defined by fiber walls and the substances are deposited in the interior cavities during fiber loading so as to form a solid layer, thereby providing, one of, a coating on the interior cavities or filling them in some locations. The solid layers arc also made to break apart during the glazing step so as to form a separation layer between the fiber walls.

The process provides for the substances to penetrate into the paper fibers during the preparation step. The substances being calcium carbonate, such that the calcium carbonate is made to crystallize inside the paper fibers.

The process provides for the substances to comprise at least two components which are added to the fibrous material suspension at different times.

According to another aspect of the invention, the process provides for the fibrous material suspension to be produced from recycled paper which is freed of ink by a de-inking process.

The process provides for the glazing to be performed at a pressure of at least 30 $N/mm^2$, preferably at a pressure of at least 60 $N/mm^2$. The process also provides for the glazing to be performed by a supercalender.

According to another aspect of the invention, the process is for the production of glazed paper wherein a stock is prepared by providing a fibrous material suspension for processing in a paper making machine wherein the fibrous material suspension is produced from recycled paper which is freed of ink by a de-inking process; a paper web is formed, such that the paper web is dried and produced from the fibrous material suspension; and the paper web is glazed using glazing surfaces which are pressed against each other at a pressure. The stock is also subjected to fiber loading in the preparing step using substances which are deposited in the interior cavities during fiber loading so as to form a solid layer, thereby providing, one of, a coating on the interior cavities or filling them in some locations such that the solid layer breaks apart during the glazing step so as to form a separation layer between the fiber walls. Further, the substances comprise at least two components which are added to the fibrous material suspension at different times, wherein the substances comprise calcium carbonate such that the calcium carbonate is made to crystallize inside the paper fibers.

BRIEF DESCRIPTION OF THE DRAWINGS

The present invention is further described in the detailed description which follows, in reference to the noted plurality of drawings by way of non-limiting examples of embodiments of the present invention, in which like reference numerals represent similar parts throughout the several views of the drawings, and wherein.

The invention is explained with reference to drawings. They depict.

DETAILED DESCRIPTION OF THE PRESENT INVENTION

Figure 1:
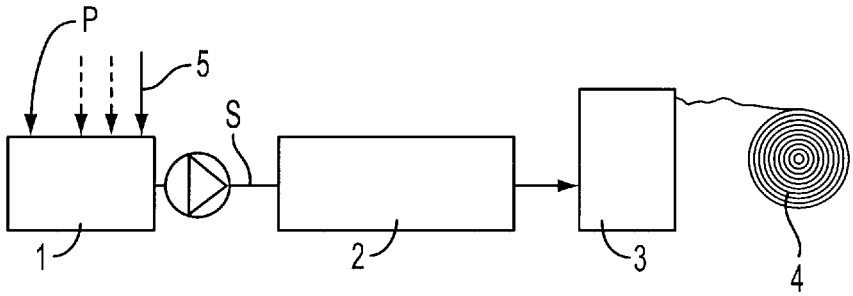
FIG. 1 the basic sequence of the process.

FIG. 1 primarily depicts three process sections, i.e., stock preparation 1, paper formation 2, and glazing 3. It is, understood that at least the first two process sections are made up of a large number of process steps. Thus, for example, in paper formation section, at least a headbox incorporating wet section, a subsequent press section, and a dry end are generally, necessary. Process section 2 usually also includes the entire paper machine. The subsequent glazing section 3 may be part of the paper machine, it may be carried out in a separate apparatus. In conventional glazing, it is known that calenders or supercalenders are suitable. For this reason the depiction in the drawings is unnesessary since such paper glazing apparatuses have long been known. The finished, glazed paper may then be conventionally wound to form a roll 4.

A number of different process steps also usually takes place in stock preparation 1, for example, the paper stock P which is delivered must usually be suspended, deflaked, and cleaned. Such steps are generally known. It is an important aspect of the process according to the invention that, among other things, the substances 5 are added in this process section and processed such that they bring about the effect already described. The paper stock thus treated arrives in the paper formation section 2, for example, as a pumpable fibrous material suspension S.

Figure 2:
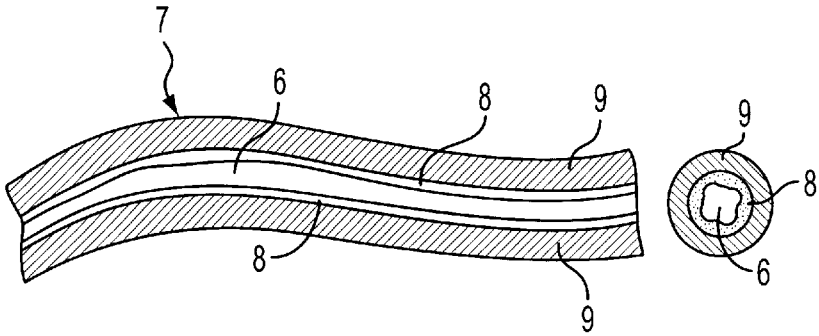
FIG. 2 sketch of a loaded paper fiber, greatly enlarged.

In FIG. 2, a single paper fiber 7 is sketched in a greatly enlarged view, and also, obviously, cross-section both lengthwise (left) and crosswise (right). It is recognized that these paper fibers have internal cavities 6, so-called lumens, and that during implemention of the process according to the invention, a solid layer 8 forms inside this lumen. This solid layer 8 coats the interior cavity 6 and which increases the deformation resistance of the paper fiber 7 such that damaging compression of the fiber is prevented during the glazing process. The cavity may either maintain its shape, which results in a greater volume of the glazed paper, or the fiber may be compressed such that a separation layer 8' is formed from the solid layer 8. Other solid layers, which are not shown here, may also form at other locations of the fiber.

Figure 3:
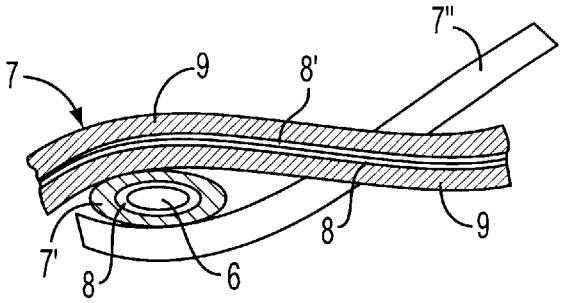
FIG. 3 stress situation during glazing.

FIG. 3 depicts in greatly simplified form the process steps that may occur during the glazing process. The three paper fibers 7, 7', 7" treated according to the invention shown here, of which two are shown in cross section, are pressed against each other as a result of the pressing force acting in the calender. Here, by way of example, the compression in the paper fiber 7 depicted in longitudinal section has progressed to the extent that the previously existing cavity has essentially disappeared. However, since a separation layer 8' has been formed by the solid layer, the compression of the fiber walls 9, i.e., complete collapse of the cavity is prevented. Thus, an undesirable reduction in opacity does not occur. In the paper fiber 7' depicted in transverse cross-section, some of the internal fiber cavity 6 has been retained, since the solid layer 8 has improved the resistance to compression. In many types, both deformation cases are present in the same sheet of paper.

Figure 4:
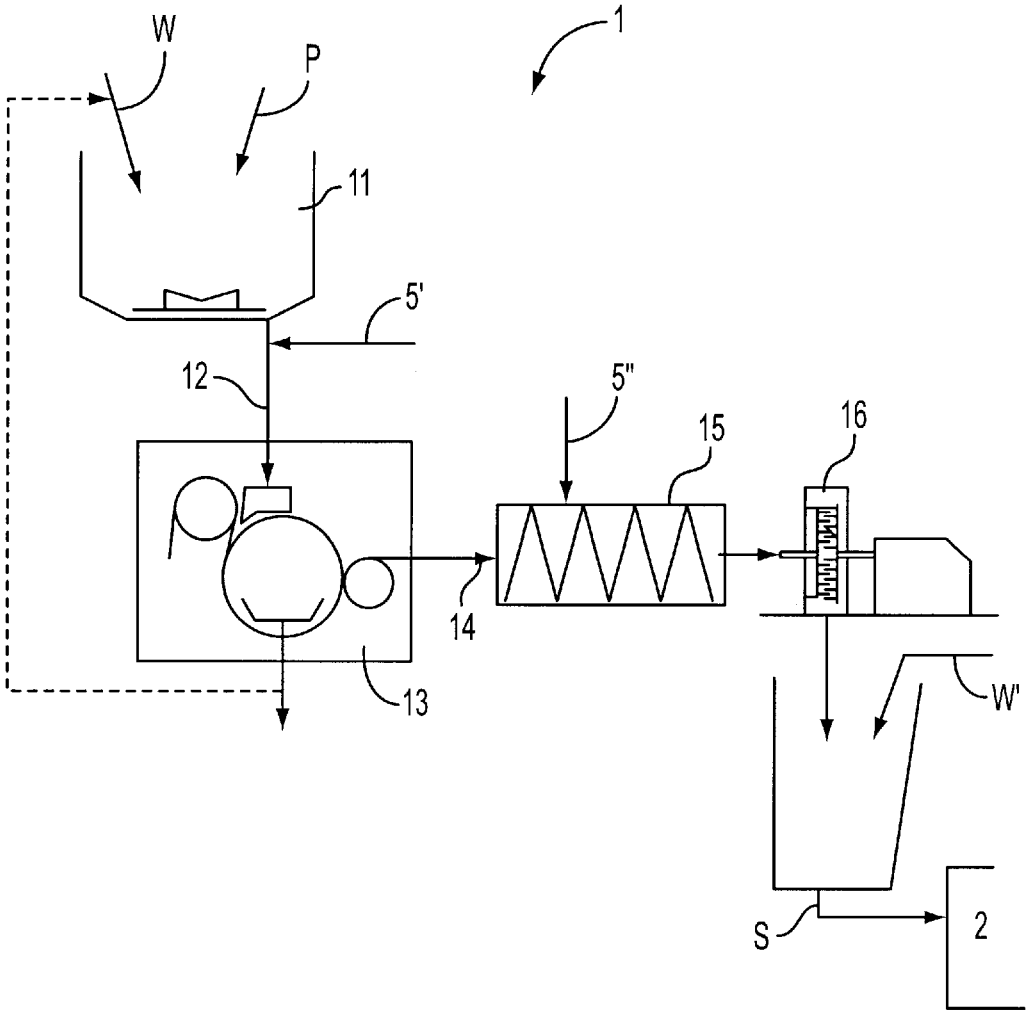
FIG. 4 an exemplary possibility for fiber loading.

The system for stock preparation 1 depicted in FIG. 4 in rough schematic form, represents one way in which a fibrous material suspension S can be treated according to the invention. The paper stock P is thoroughly mixed, as is customary, with water W in a pulper 11 and suspended such that a pumpable suspension 12 can be drawn off. The substances 5 which are transported into the interior cavities of the fibers consist of two components, i.e., a basic material 5' and a reaction material 5", with the components being added one after another at different locations.

When the paper stock P has been obtained from recycled paper, a thorough cleaning of unwanted components from the recycled paper is essential in virtually all cases. This aspect is, not depicted here. Additionally, if for example, the suspension 12 has been excessively diluted for the cleaning procedures, a decker 13 can adjust the necessary solids content. Under those circumstances the thick stock 14 drawn from the decker 13 arrives in a reaction chamber 15 to be thoroughly mixed with the reaction material 5". In a disperser 16 connected downstream, the fiber loading is completed with the use of high shearing forces. The stock thus produced is then diluted with water W' and arrives as a fibrous material suspension S in the subsequent process section, the paper formation 2.

The system described in FIG. 4 represents merely one of the conceivable possibilities for designing the stock preparation 1 section in the performance of the process according to the invention.

What is claimed is:

1. A process of improving the glazing of paper by loading fibers with fillers and glazing the paper in a calender so as to minimize a black glazing effect, the process comprising:

preparing a stock by providing a fibrous material suspension for processing in a paper making machine;

forming a paper web, said paper web being dried and being produced from the fibrous material suspension; and glazing the paper web using glazing surfaces which are pressed against each other at a pressure;

wherein the stock is subjected to fiber loading in the preparing step using substances which are transported into the fibers such that the substances increase the volume of the fibers in their transverse dimension by forming expanding solid layers.

2. The process of claim 1, wherein the fibers have interior cavities defined by fiber walls and the substances are deposited in the interior cavities during fiber loading so as to form a solid layer, thereby providing, one of, a coating on the interior cavities or filling them in some locations.

3. The process of claim 2, wherein the solid layer breaks apart during the glazing step so as to form a separation layer between the fiber walls.

4. The process of claim 1, wherein the substances penetrate into the fibers during the preparation step, said substances comprising calcium carbonate;

wherein the calcium carbonate is made to crystallize inside the paper fibers.

5. The process of claim 1, wherein the substances comprise at least two components which are added to the fibrous material suspension at different times.

6. The process of claim 1, wherein the fibrous material suspension is produced from recycled paper which is freed of ink by a de-inking process.

7. The process of claim 1, wherein the glazing step is preformed at a pressure of at least 30 $N/mm^2$.

8. The process of claim 1, wherein the glazing is performed at a pressure of at least 60 $N/mm^2$.

9. The process of claim 1, wherein the glazing is preformed by a supercalender type calender.

10. A process of improving the glazing of paper by loading fibers with fillers and glazing the paper in a calender so as to minimize a black glazing effect, the process comprising:

preparing a stock by providing a fibrous material suspension for processing in a paper making machine;

forming a paper web, said paper web being dried and being produced from the fibrous material suspension; and glazing the paper web using glazing surfaces which are pressed against each other at a pressure;

wherein the stock is subjected to fiber loading in the preparing step using substances which are transported into the interior of the fibers so as to increase their resistance against compression.

11. The process of claim 10, wherein the fibers have interior cavities defined by fiber walls and the substances are deposited in the interior cavities during fiber loading so as to form a solid layer, thereby providing, one of, a coating on the interior cavities or filling them in some locations.

12. The process of claim 11, wherein the solid layer breaks apart during the glazing step so as to form a separation layer between the fiber walls.

13. The process of claim 10, wherein the substances penetrate into the paper fibers during the preparation, said substances comprising calcium carbonate;

wherein the calcium carbonate is made to crystallize inside the paper fibers.

14. The process of claim 10, wherein the substances comprise at least two components which are added to the fibrous material suspension at different times.

15. The process of claim 10, wherein the fibrous material suspension is produced from recycled paper which is freed by ink by a de-inking process.

16. The process of claim 10, wherein the glazing step is preformed at a pressure of at least 30 $N/mm^2$.

17. The process of claim 16, wherein the glazing is performed at a pressure of at least 60 $N/mm^2$.

18. The process of claim 10, wherein the glazing is performed by a supercalender type calender.

19. A process of improving the glazing of paper by loading fibers with fillers and glazing the paper in a calender so as to minimize a black glazing effect, the process comprising:

preparing a stock by providing a fibrous material suspension for processing in a paper making machine wherein the fibrous material suspension is produced from recycled paper which is freed of ink by a de-inking process;

forming a paper web, said paper web being dried and being produced from the fibrous material suspension;

glazing the paper web using glazing surfaces which are pressed against each other at a pressure;

the stock being subjected to fiber loading in the preparing step using substances which are deposited in the interior cavities during fiber loading so as to form a solid layer, thereby providing, one of, a coating on the interior cavities or filling them in some locations such that the layer breaks apart during the glazing step so as to fold a separation layer between the fiber walls, wherein the substances comprise at least two components which are added to the fibrous material suspension at different times, said substances comprising calcium carbonate such that the calcium carbonate is made to crystallize inside the paper fibers.

20. A process of improving the glazing of paper by loading fibers with fillers and glazing the paper in a calender so as to minimize a black glazing effect, the process comprising:

preparing a stock from a fibrous material suspension which includes the paper fibers;

subjecting the stock to fiber loading using substances which are transported into the fibers such that the substances increase the volume of the paper fibers in their transverse dimension by forming expanding solid layers;

processing the stock in a paper making machine so as to form a paper web;

drying the paper web;

glazing the paper web in a calender, wherein the paper web is glazed in the calender with a minimized black satin effect.

* * * * *